US008319802B2

(12) United States Patent
Chen et al.

(10) Patent No.: US 8,319,802 B2
(45) Date of Patent: Nov. 27, 2012

(54) APPARATUS TO SELECT GAMMA REFERENCE VOLTAGE AND METHOD OF THE SAME

(75) Inventors: Ping-Hsien Chen, Pingtung (TW); Bi-Hsien Chen, Sinjhuang (TW)

(73) Assignee: Chunghwa Picture Tubes, Ltd., Taoyuan County (TW)

( * ) Notice: Subject to any disclaimer, the term of this patent is extended or adjusted under 35 U.S.C. 154(b) by 522 days.

(21) Appl. No.: 12/625,796

(22) Filed: Nov. 25, 2009

(65) Prior Publication Data

US 2011/0025722 A1 Feb. 3, 2011

(30) Foreign Application Priority Data

Jul. 31, 2009 (TW) ..... 98126007 A

(51) Int. Cl.
*G09G 5/10* (2006.01)

(52) U.S. Cl. ..... 345/690; 345/89; 345/213

(58) Field of Classification Search ..... None
See application file for complete search history.

(56) References Cited

U.S. PATENT DOCUMENTS

| | | | | |
|---|---|---|---|---|
| 6,593,934 | B1 * | 7/2003 | Liaw et al. | 345/590 |
| 8,194,015 | B1 * | 6/2012 | Orlando et al. | 345/87 |
| 2008/0068404 | A1 * | 3/2008 | Ishii | 345/690 |
| 2008/0284775 | A1 * | 11/2008 | Shen et al. | 345/214 |
| 2010/0277519 | A1 * | 11/2010 | Lee | 345/691 |

* cited by examiner

*Primary Examiner* — Jason Olson
(74) *Attorney, Agent, or Firm* — Ming Chow; Sinorica, LLC

(57) ABSTRACT

The present invention provides a method of selecting a gamma reference voltage. The method is used to switch the picture to a first grey scale. The second grey scale and its luminance of a plurality of regions of a liquid crystal display panel are determined by a sensor, and the gamma voltage corresponding to the second grey scale is stored into a bank to output. The bank signal is input to a reference voltage.

7 Claims, 12 Drawing Sheets

APPARATUS TO SELECT GAMMA REFERENCE VOLTAGE AND METHOD OF THE SAME

BACKGROUND

1. Field of the Invention

This invention relates to a liquid crystal display panel, and more particularly to an apparatus to select a gamma reference voltage and method of the same which is utilized by cell gap pattern to correct the gamma reference voltage.

2. Description of the Prior Art

With the development of the optical technology and the semiconductor technology, a liquid crystal display device is generally applied for consumer displays. In general, the liquid crystal display device has the advantages including high-definition, small volume, light weight, low driving voltage, low power dissipation and more applications, and thereby to be as main technology of a display device to replace conventional cathode-ray tube displays.

In general, a liquid crystal display device includes two substrates, liquid crystals sealed there-between, pixel electrode, thin film transistor configured on one substrate, color filter film corresponding to each one of the pixel electrodes and common electrode disposed on the other substrate. The color filter film consists of Red, Green and Blue three color filter films, and each one of the pixels has one of the three color filter films formed thereon. Red, Green and Blue pixel are disposed adjacent together to form one pixel.

An image is shown on a liquid crystal display panel input by an outside video data. The image is transmitted to cerebrum via eyes to reproduce the shown image, and therefore the video data transfers to Somatosensory. The video data is achieved to a direct proportion to the Somatosensory by an ideal gamma curve. The gamma curve represents as a relation between brightness and Somatosensory (gray scale) which is a non-linear relation. The liquid crystal display panel needs to be corrected gamma reference when practical gamma curve deviates from the ideal gamma curve. A gamma correction voltage is applied to liquid crystal area to alter brightness of the liquid crystal such that the practical gamma curve approaches to the ideal gamma curve, and thereby achieving a direct proportion between the video data and the Somatosensory to gain a high quality picture. In the liquid crystal display panel, gamma correction voltage is output to a driver IC of the liquid crystal display panel, and then output into the liquid crystal display panel via R-string resistor divider of the driver IC to create a required voltage for liquid rotation such that a correct picture is shown on a screen.

Currently, a gamma voltage is adjusted based-on uniform cell gap of a liquid crystal display panel. When the cell gap is not uniform owing to process factor, especially large size panel, it needs to rework for gamma voltage correction to compensate difference due to the cell gap. Moreover, a gamma voltage of a liquid crystal display panel is adjusted based-on a single point (in general set at center point) to measure brightness of gray scale for determining gamma voltage of the liquid crystal display panel. As non-uniform cell gap, a gamma voltage by signal point measuring can not been corrected the difference due to the cell gap. In manufacturing a liquid crystal display panel, if found excessive cell gap difference; it can not timely correct the gamma voltage to compensate the difference due to the cell gap.

In view of the aforementioned drawbacks, the present invention provides an improved concept without found and teaching in the prior art for efficiently resolving gamma voltage correction issue due to cell gap difference.

SUMMARY OF THE INVENTION

To overcome the prior art drawbacks, the present invention provides a method of selecting a gamma voltage of a liquid crystal display panel, which utilizes a cell gap pattern to detect difference of cell gap of the liquid crystal display panel to select data of pre-storing in banks for correcting the gamma voltage.

Another objective of the present invention is to provide a method for correcting the gamma voltage and provide a simple compensating difference due to the cell gap, and thereby easily correcting the gamma voltage.

Yet another objective of the present invention is to provide a method for correcting a gamma voltage, based-on the cell gap pattern manually selecting the gamma voltage by visual detection pattern or automatically selecting the gamma voltage by sensor detecting.

The present invention discloses a method of selecting a gamma voltage of a liquid crystal display panel. The method comprises storing a plurality of first gamma voltage in a plurality of banks of a reference voltage apparatus; measuring a second gamma voltage of divided sections of a liquid crystal display panel, storing the second gamma voltage in one of the plurality of banks; and utilizing a sensor measuring or pattern selecting to select corresponding one of the plurality of first gamma voltage to compensate difference due to the cell gap of the divided sections.

The divided sections are lateral equi-partition sections. The sensor measuring comprises: storing first brightness, based-on corresponding a plurality of first gray scale of a standard liquid crystal display panel; switching a picture to one of the plurality of first gray scale for measuring second brightness of the second gray scale of the divided sections by the sensor, storing one of the plurality of first gamma voltage corresponding to the second gray scale in one of the plurality of banks as output; and inputting one signal of the plurality of banks into the reference voltage apparatus. The pattern selecting comprises storing first brightness, based-on corresponding a plurality of first gray scale of a standard liquid crystal display panel; switching a picture to one of the plurality of first gray scale, selecting the second gray scale of one of the divided sections of the closest to the first gray scale by the visual method, storing one of the plurality of first Gamma voltage corresponding to the second gray scale in one of the plurality of banks as output; and inputting one signal of the plurality of banks into the reference voltage apparatus.

A system for selecting a gamma voltage of a liquid crystal display panel comprises a DC/DC converter; a reference voltage coupled to the DC/DC converter, having a plurality of banks, each one of the plurality of banks for storing the gamma voltage; a timing controller, coupled to the reference voltage apparatus for setting and controlling signals of the plurality of banks; a source driver, coupled to the timing controller and the reference voltage apparatus for corresponding gamma voltage of each one of plurality of banks outputting to the source driver; a gate driver, coupled to the timing controller for turning on or off a transistor; and a liquid crystal display panel, coupled to the gate driver and the source driver.

The system further comprises an adjusting tool coupled to the reference voltage apparatus and the liquid crystal display panel. The adjusting tool comprises a terminating machine; an adjusting module, coupled to the terminating machine and the reference voltage apparatus for transmitting first signal to one of the plurality banks to output the corresponding gamma voltage, wherein the adjusting module includes a microprocessor; a signal generator, coupled to the terminating machine and the liquid crystal display panel for providing second signal to the liquid crystal display panel; and a sensor, coupled to the liquid crystal display panel and the adjusting module for detecting brightness of the liquid crystal display panel.

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENT

Some sample embodiments of the invention will now be described in greater detail. Nevertheless, it should be recognized that the present invention can be practiced in a wide range of other embodiments besides those explicitly described, and the scope of the present invention is expressly not limited expect as specified in the accompanying claims.

As a cell gap difference of a liquid crystal display panel is found, a gamma voltage and a color tracking need to be adjusted. The present invention utilizes a cell gap pattern to distinguish the cell gap difference and to select data prestored in a gamma buffer IC for further correcting a gamma voltage.

Implement method of the present invention, when the cell gap difference of a liquid crystal display panel is found during production-line detecting, based-on relation between the cell gap corresponding to the gamma voltage and the Color Tracking for automatically correcting the gamma voltage by equipment integrating. It can save time without re-adjusting the equipment location.

Every one liquid crystal display panel of the present invention is divided into pluralities of equal lateral sections. Gamma voltage of the equal lateral sections is measured by corresponding sensors, and thereby storing measurement data on its corresponding bank. Bank signal is transmitted to a reference voltage apparatus by a timing controller to select the corresponding bank for outputting a gamma voltage of the corresponding bank to a source driver. In a frame rate cycle, data enable of a gate driver is divided into a plurality of sections. Based-on the cell gap difference of the lateral divided sections of every one liquid crystal display panel, suitable gamma voltage is to been automatically selected by utilizing sensor measuring or selected by visual method of pattern to compensate the difference due to the cell gap. The cell gap may be a distance (gap) parameter between an active device array substrate and a color filter substrate.

Figure 1:
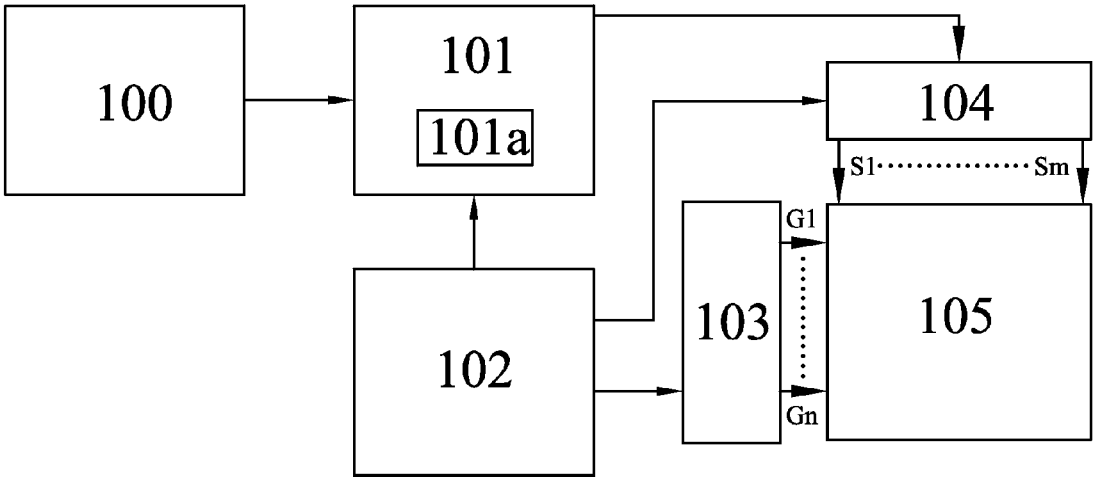
FIG. 1 shows a system architecture of measuring a gamma voltage of a liquid crystal display panel according to the present invention.

As shown in FIG. 1, it shows a system architecture diagram of measuring Gamma voltage of a liquid crystal display panel which includes a DC/DC converter 100, a reference voltage apparatus 101, a timing controller 102, a gate driver (IC) 103, a source driver (IC) 104 and a TFT-LCD panel 105. The reference voltage apparatus 101 may be a cell gap reference voltage apparatus. In this embodiment, a plurality of banks 101*a* are programmed in the reference voltage apparatus 101, wherein every one of the plurality of banks 101*a* is used to store a specific gamma voltage. The timing controller 102 has a function for controlling signal of the banks 101*a*. The signal of the banks 101*a* may be set and controlled by the timing controller 102. The timing controller 102 may transmit the bank signal to the reference voltage apparatus 101 to decide or select the specific bank 101*a* for outputting corresponding Gamma voltage to the source driver (IC) 104.

Figure 2:
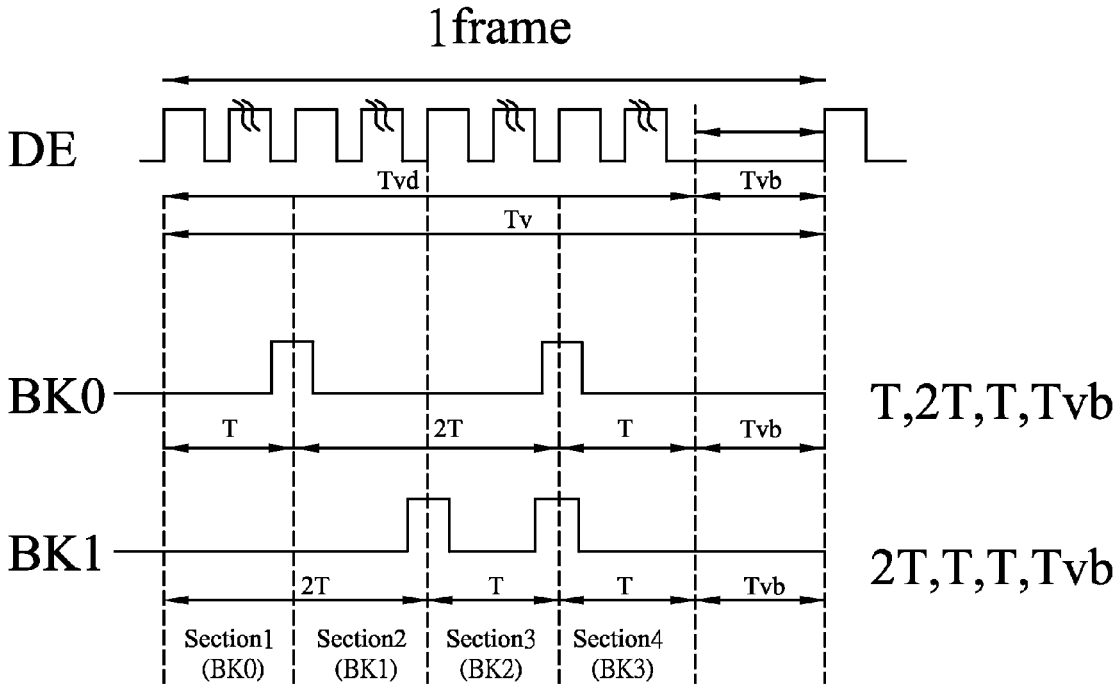
FIG. 2 shows a timing chart of gate signal and bank signal of the four measuring sections of a liquid crystal display panel according to the present invention.
Figure 3:
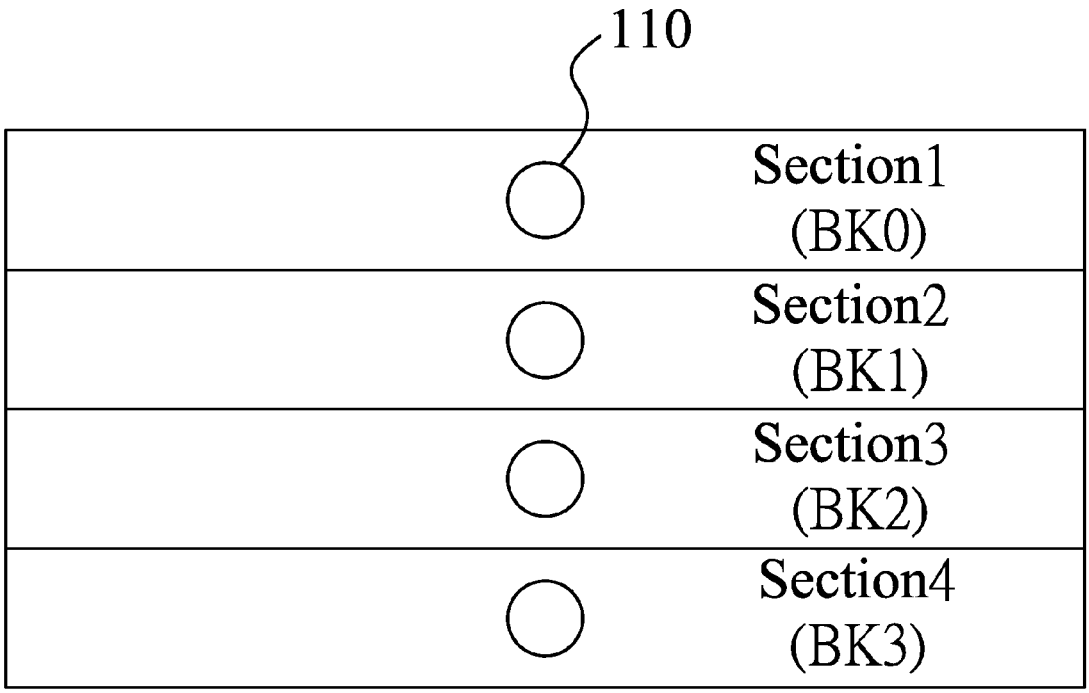
FIG. 3 shows a four measuring divided sections of a liquid crystal display panel according to the present invention.
Figure 4:
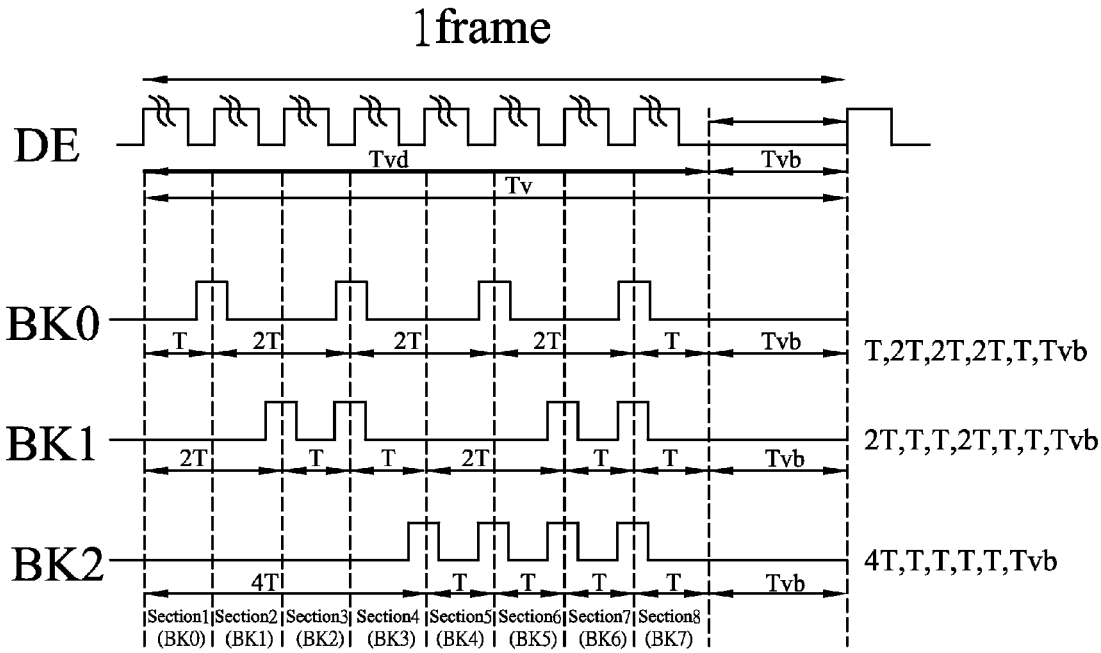
FIG. 4 shows a timing chart of gate signal and bank signal of eight measuring divided sections of a liquid crystal display panel according to the present invention.
Figure 5:
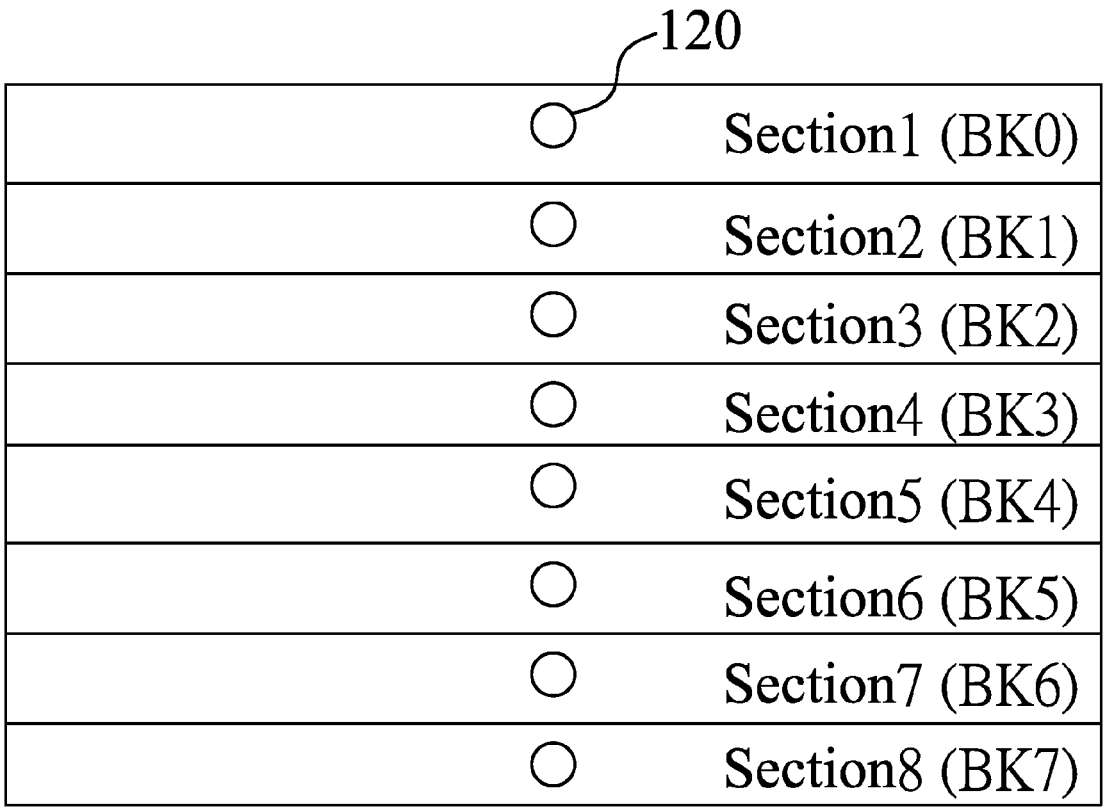
FIG. 5 shows an eight measuring divided sections of a liquid crystal display panel according to the present invention.

As shown in FIG. 3, it shows four or less measuring divided sections of a liquid crystal display panel. FIG. 2 shows a timing chart of gate signal and bank signal of the four measuring sections of the FIG. 3. Moreover, in FIG. 4, it shows a timing chart of gate signal and bank signal of eight or less measuring divided sections of a liquid crystal display panel. For example, in a frame rate cycle, in vertical active display term, total frame rate cycle Tv is equal to vertical display cycle Tvd plus vertical blanking cycle Tvb, wherein the vertical display cycle Tvd may be a data enable cycle. In a frame rate cycle, interval of the data enable of the gate driver 103 is divided into a plurality of sections, and scanning lines of each one of the sections are the same. The scanning lines scanned in each one of the sections of a liquid crystal display panel are the same, and therefore the TFT-LCD panel 105 is divided into a plurality of sections. In one embodiment, equi-partition sections of the TFT-LCD panel are the same as the divided sections of the data enable interval. As shown in the FIG. 3, data enable interval is divided into four sections, which are first section (BK0), second section (BK1), third section (BK2) and fourth section (BK3), respectively. As shown in FIG. 5, data enable interval is divided into eight sections, which are first section (BK0), second section (BK1), third section (BK2), fourth section (BK3), fifth section (BK4), sixth section (BK5), seventh section (BK6) and eighth section (BK7), respectively. Period (T) of each one of the sections follows the equation, $T=T_{vd}/n$, wherein n is divided section number of the data enable interval, and $T_{vd}$ is data enable period. A plurality of banks are programmed in the reference voltage apparatus 101, number of the banks is the same as the divided section number of the data enable interval of the gate driver 103. Each one of the banks may store a specific Gamma voltage of each one of the sections in a TFT-LCD panel 105. Besides, Gamma voltage of the first section (BK0), second section (BK1), third section (BK2) and fourth section (BK3) of the TFT-LCD panel 105 is measured at measuring point 110 by a sensor. The measuring value is stored in the corresponding bank, shown in the FIG. 3. In the FIG. 5, a gamma voltage of the first section (BK0), second section (BK1), third section (BK2), fourth section (BK3) fifth section (BK4), sixth section (BK5), seventh section (BK6) and eighth section (BK7) of the TFT-LCD panel 105 is measured at measuring point 120 by a sensor. Similarly, the measuring value is stored in the corresponding bank.

To implement correction of the gamma voltage of the TFT-LCD panel of the present invention, firstly, a gamma voltage is selected in un-determined cell gap. In different cell gap situation, making theorem of different cell gap pattern is described as following. In general, relation of brightness (Y), gray scale (X) and Gamma value (γ) is as below:

$$Y = a * X^{\gamma} + b \text{ wherein } a = \frac{Y_{max} - Y_{min}}{X_{max}^{\gamma}},\ b = Y_{min},$$

$Y_{max}$=maximum brightness, $Y_{min}$=minimum brightness, and therefore $$\left(\frac{X}{X_{max}}\right)^{\gamma} = \left(\frac{Y - Y_{min}}{Y_{max} - Y_{min}}\right) \tag{1}$$

Figure 6:
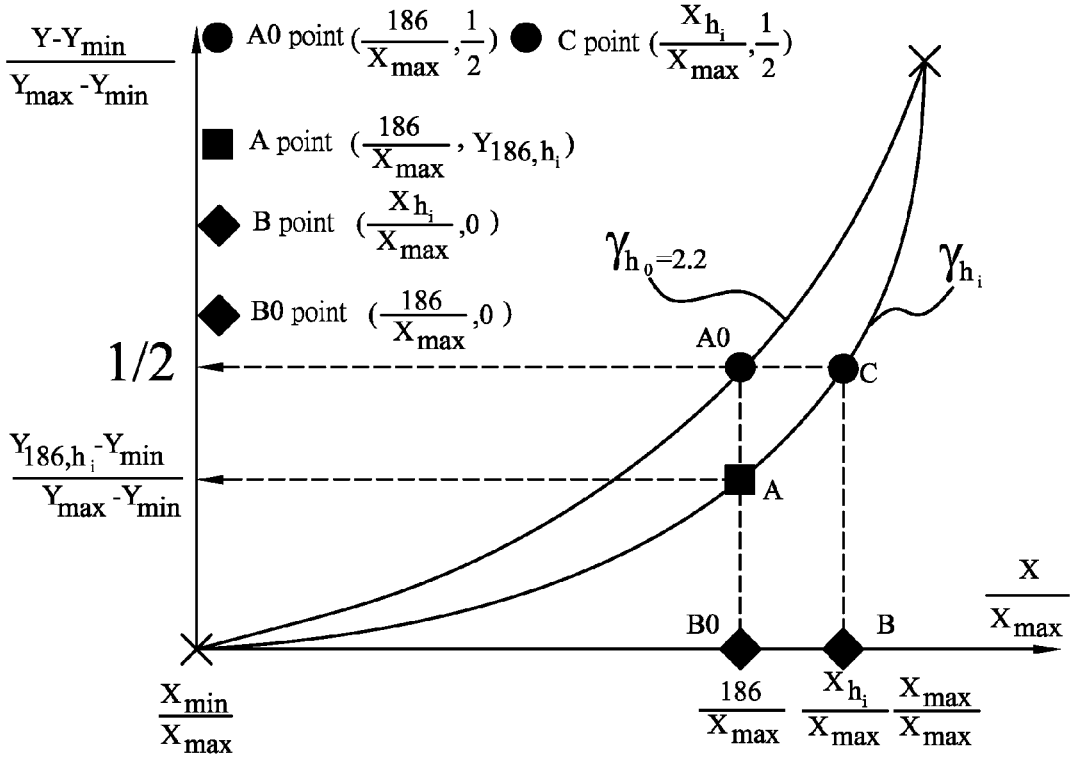
FIG. 6 shows a graph of brightness, gray scale and gamma value of a liquid crystal display panel according to the present invention.

Graph of equation (1) is shown as FIG. 6.

If Gamma value follows $\gamma_{h_0}$=2.2, and $X_{max}$=255, $Y_{min}$≅0, then $$\frac{Y - Y_{min}}{Y_{max} - Y_{min}} \cong \frac{Y}{Y_{max}}.$$

If brightness of some gray scale is assigned as one half of the maximum brightness, $$\text{i.e. } \frac{Y}{Y_{max}} = \frac{1}{2},$$

then the gray scale may be determined by the equation (1), which can be represented as $X_{h_0}$=0.73*$X_{max}$=186, $$\text{i.e. } \frac{X_{h_0}}{X_{max}} = \frac{186}{X_{max}} = 0.73,$$

shown as Bo point of the FIG. 6.

Sign explanation as below, $h_i$: cell gap size $X_{h_0}$: gray scale at cell gap size $h_0$, Gamma value $\gamma=\gamma_{h_0}$=2.2, brightness ½ $Y_{max}$ $Y_{max}$: maximum brightness $X_{h_i}$: gray scale at cell gap size $h_i$, Gamma value $\gamma=\gamma_{h_i}$, brightness ½ $Y_{max}$ $Y_{186,h_i}$: brightness at cell gap size $h_i$, gray scale $X_{h_i}$=186

If Gamma vale is $\gamma_{h_i}$, it may be derived as below by utilizing the equation (1), $$\left(\frac{X}{X_{max}}\right)^{\gamma_{h_i}} = \left(\frac{Y - Y_{min}}{Y_{max} - Y_{min}}\right)$$

Assume:

$X_{min}$=0, $X_{max}$=255, brightness of $Y_{186,h_i}$ and $Y_{min}$, $Y_{max}$ are measured, shown in A point of the FIG. 6, equation (2) may be derived as following by utilizing the equation (1), $$\left(\frac{186}{255}\right)^{\gamma_{h_i}} = \left(\frac{Y_{186,h_i} - Y_0}{Y_{255} - Y_0}\right) \tag{2}$$

One half of the maximum brightness $$\frac{Y - Y_{min}}{Y_{max} - Y_{min}} \cong \frac{Y}{Y_{max}} = \frac{1}{2} X_{h_i}$$

is shown in C point of the FIG. 6. Equation (3) may be derived as below by utilizing the equation (1), $$\left(\frac{X_i}{255}\right)^{\gamma_{h_i}} = \frac{1}{2} \tag{3}$$

Simplifying the equation (2) and the equation (3), equations (4) and (5) may be derived as following, $$\gamma_{h_i} * \log\left(\frac{186}{255}\right) = \log\left(\frac{Y_{186,h_i} - Y_0}{Y_{255} - Y_0}\right) \tag{4}$$

$$\gamma_{h_i} * \log\left(\frac{X_{h_i}}{255}\right) = \log\left(\frac{1}{2}\right) \tag{5}$$

Equation (4) divided by equation (5) equals $$\log\left(\frac{X_{h_i}}{255}\right) = \frac{\log\left(\frac{186}{255}\right) * \log\left(\frac{1}{2}\right)}{\log\left(\frac{Y_{186,h_i} - Y_0}{Y_{255} - Y_0}\right)}$$

Let $$K = \frac{\log\left(\frac{186}{255}\right) * \log\left(\frac{1}{2}\right)}{\log\left(\frac{Y_{186,h_i} - Y_0}{Y_{255} - Y_0}\right)} < 0$$

Wherein K is below zero, relation with $Y_{186,h_i}$, $Y_0$, $Y_{255}$. If $Y_0$, $Y_{255}$ is constant, then K is only relation with $Y_{186,h_i}$, function of $K(Y_{186,h_i})$. Therefore, gray scale $X_{h_i}$ is only relation with $Y_{186,h_i}$. The relation is described as below function (6):

$$X_{h_i}=255*\exp\left[K(Y_{186,h_i})\right] \tag{6}$$

Equation (6) shows the relation between gray scale $X_{h_i}$ and brightness $Y_{186,h_i}$ of a liquid crystal display panel. From above-mentioned, A point and C point of the cell gap $h_i$ graph are substituted into the equation (1) to derive the relation between the gray scale $X_{h_i}$ and the brightness $Y_{186,h_i}$. The brightness $Y_{186,h_i}$ of the measured A point can derive the gray scale $X_{h_i}$ which may further determine the cell gap size $h_i$. Above descriptions are theorem of selecting a gamma voltage by the cell gap pattern and further correcting the gamma voltage.

Figure 7:
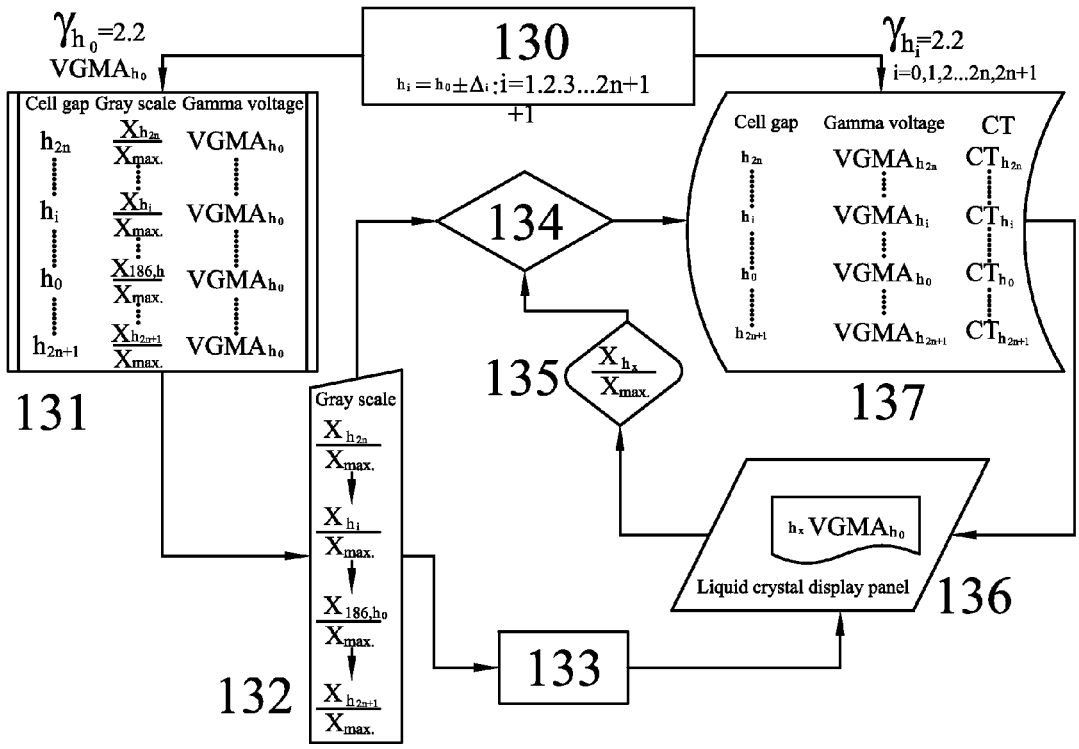
FIG. 7 shows a process flow of selecting a gamma voltage of a liquid crystal display panel in un-determined cell gap according to the present invention.

In un-determined cell gap, process of selecting the gamma voltage is referred to FIG. 7. The process includes three steps, first step, a plurality of banks are programmed in the reference voltage apparatus to provide a gamma voltage; second step, the cell gap pattern is made; third step, in un-determined cell gap size, selecting the gamma voltage by utilizing sensor measuring or by visual method of pattern.

In the first step, pluralities of banks are programmed in the reference voltage apparatus as a gamma voltage. Firstly, standard liquid crystal display panels with uniform and various cell gap size ($h_i=h_0\pm\Delta_i$; i=1, 2, 3 . . . 2n, 2n+1) are selected, shown in block 130. Each one of the liquid crystal display panels uses a gamma voltage $VGM_{h_i}$, cell gap $h_i(\gamma=2.2)$, and programming banks in the reference voltage apparatus. Each $Bank_{h_i}$ stores a specific gamma voltage $VGM_{h_i}$ measured by the standard liquid crystal display panels with the cell gap size $h_i$. Each gamma voltage corresponds to Gamma value, $\gamma=2.2$, shown in block 137. Relation of function shows as below, $$Bank_{h_i}\approx funB(VGM_{h_i})|_{\gamma=2.2}$$

wherein i is number of the cell gap.

In one embodiment, maximum value is six (i=0, . . . , 6). When the cell gap size is $h_0$, measuring the Gamma value ($\gamma_{h_0}=2.2$) and gamma voltage, and the gamma voltage is pre-stored in $Bank_{h_0}$ of a gamma store device. Similarly, a gamma voltage of the cell gap size $h_1$~$h_6$ is pre-stored in $Bank_{hi}$ to $Bank_{h6}$ of the gamma store device. Corresponding relation refers to the first appendix (table one). The first appendix represents as relation between $h(\gamma_{h_i}=2.2)$ and corresponding $Bank_{h_i}$.

TABLE ONE

| Cell gap size $h_i \approx h(\gamma_{h_i}=2.2)$ | $Bank_{h_i} \approx funB(VGM_{h_i})\|_{\gamma=2.2}$ i = 0, . . . , 6 |
|---|---|
| $h_6$ | $Bank_{h_6}$ |
| $h_5$ | $Bank_{h_5}$ |
| $h_4$ | $Bank_{h_4}$ |
| $h_0$ | $Bank_{h_0}$ |
| $h_3$ | $Bank_{h_3}$ |
| $h_2$ | $Bank_{h_2}$ |
| $h_1$ | $Bank_{h_1}$ |
| $h_x \approx h_i$ | $Bank_{h_x}$ (Gamma voltage of this bank in one frame rate cycle) |

In the second step, the cell gap pattern is made. Standard liquid crystal display panels with uniform cell gap size ($h_i$) are specially selected, each one of the liquid crystal display panels uses a gamma voltage $VGM_{h_0}$, cell gap $h_0(\gamma=2.2)$, shown in block 131. The measured brightness $Y_{186,h_i}$ (shown in A point of the FIG. 6) is substituted into the equation (6) to find gray scale $X_{h_i}$ (shown in B point of the FIG. 6) at one half $Y_{max}$ brightness (shown in C point of the FIG. 6) for pattern making, shown in block 132.

Figure 8:
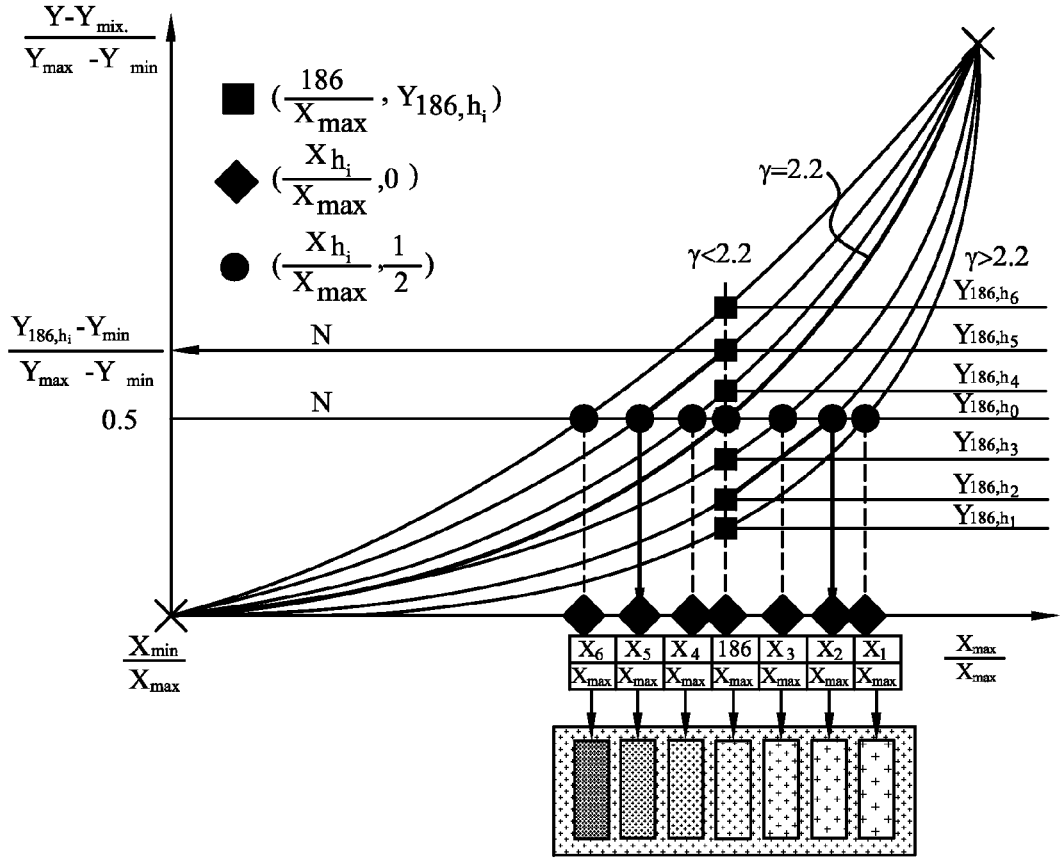
FIG. 8 shows a color of the pattern of various cell gaps in progressive distribution according to the present invention.

In one embodiment, relation between $Y_{186,h_i}$ and $X_{h_i}$ refers to the second appendix (table two). The table two represents as relation between the brightness $Y_{186,h_i}$ of cell gap $h_i(VGM_{h_0})$ and corresponding gray scale $X_{h_i}$ (at one half $Y_{max}$ brightness). The more the brightness $Y_{186,h_i}$ is, the less the gray scale is, and therefore color of the pattern is progressive distribution, shown in FIG. 8.

TABLE TWO

| Cell Gap Size $h_i$ ($VGM_{h_0}$), Brightness $Y_{186,h_i}$ | Cell Gap Size $h_i$ ($VGM_{h_0}$), gray scale $X_{h_i}$ at one half $Y_{max}$ brightness |
|---|---|
| $Y_{186,h_6}$ | $X_{h_6}$ |
| $Y_{186,h_5}$ | $X_{h_5}$ |
| $Y_{186,h_4}$ | $X_{h_4}$ |
| $Y_{186,h_0}$ | $X_{h_0}$ |
| $Y_{186,h_3}$ | $X_{h_3}$ |
| $Y_{186,h_2}$ | $X_{h_2}$ |
| $Y_{186,h_1}$ | $X_{h_1}$ |

Figure 9:
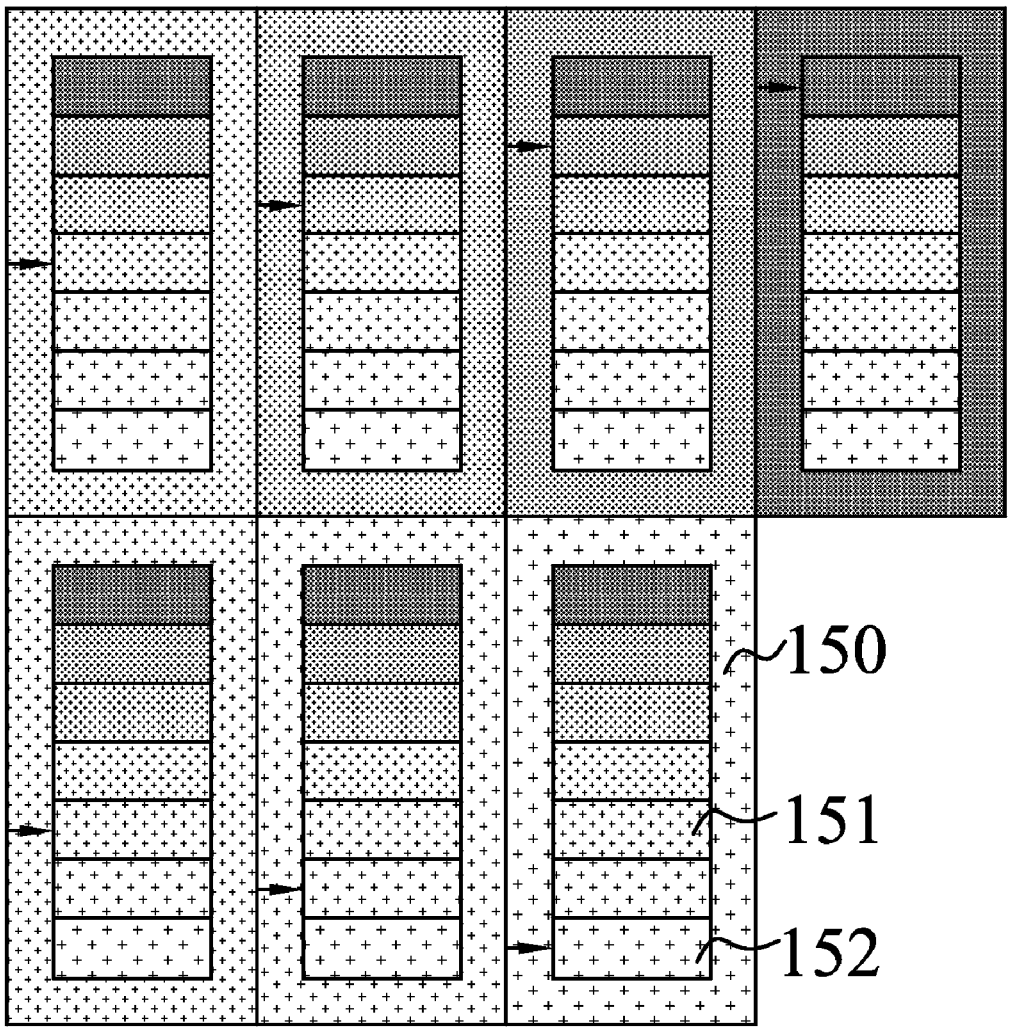
FIG. 9 shows a comparison between the picture evaluating by visual detection and manufacture complete pattern according to the present invention.
Figure 12:
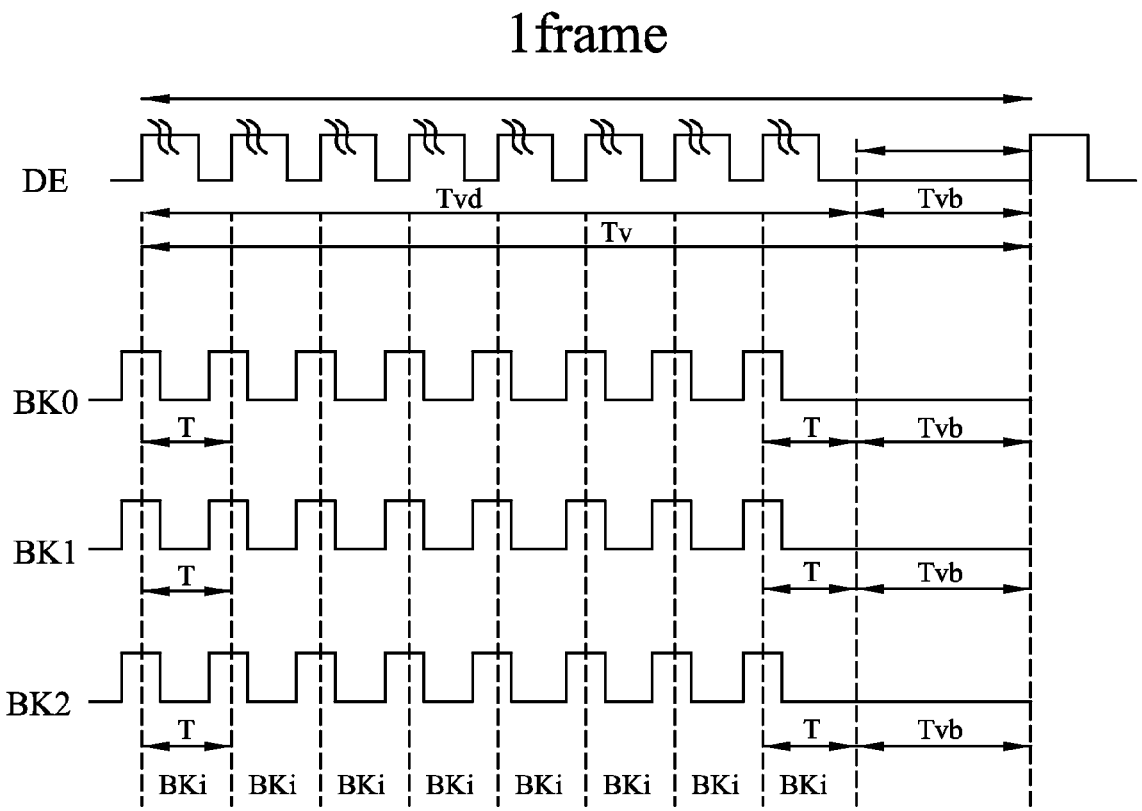
FIG. 12 shows a timing chart of gate signal and bank signal of each frame rate cycle using the identical gamma voltage according to the present invention.

In the third step, in un-determined cell gap size $h_x$, selecting a gamma voltage is made. The selecting method includes automatically selecting Gamma voltage by utilizing sensor measuring or manual selecting Gamma voltage by visual method of pattern. In selecting Gamma voltage by visual method of pattern, when the cell gap size $h_x$ is a certain un-known value, switching the picture to gray scale $X_{h_i}$, for example, $X_{h_0}$, $X_{h_1}$, $X_{h_2}$, $X_{h_3}$, $X_{h_4}$, $X_{h_5}$, $X_{h_6}$. Each switching gray scale $X_{h_i}$ compares with manufacture complete pattern 151, shown in block 134. Evaluating by visual detection of pattern is determined which gray scale picture 150 closest to the pattern 151, and thereby corresponding cell gap size $h_i$ of such gray scale $X_{h_i}$ about un-known cell gap size $h_x$, i.e. $h_x\approx h_i$. Arrow indication represents as gray scale of the pattern 151 identical with that of picture 152, shown in FIG. 9. Then, selecting a gamma voltage of the cell gap size $h_i$ corresponding to $Bank_{h_i}$ (for example the first table), the gamma voltage is stored in $Bank_{h_x}$ as output. Bank signal is set by a timing controller, and only waveform of $Bank_{h_i}$ inputs into a reference voltage apparatus which each frame rate cycle uses the identical gamma voltage, shown in FIG. 12.

Method of selecting a gamma voltage by visual of pattern is utilizing human being eyes comparing a picture of a standard liquid crystal display panel with a cell gap pattern. Pattern matching the picture is selected. Subsequently, manually selecting a key of an adjusting module 167, for example utilizing a microprocessor 167*a* to control the key, signal is transmitted to a gamma buffer device (IC) of a reference voltage apparatus 161 to store and output the gamma voltage.

Figure 10:
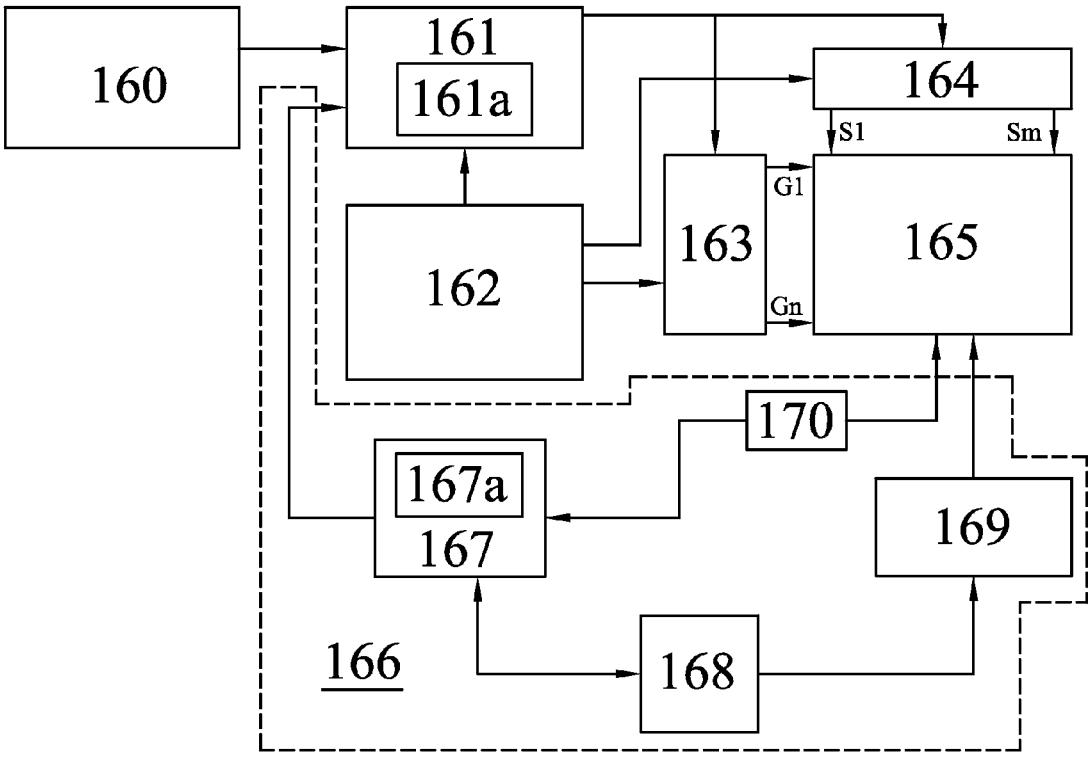
FIG. 10 shows a system architecture of an adjusting tool according to the present invention.

Moreover, in un-known cell gap size ($h_x$), another method of selecting a gamma voltage is utilizing a sensor measuring to select the gamma voltage which system architecture is shown in FIG. 10. The system architecture includes a DC/DC converter 160, a reference voltage apparatus 161, a timing controller 162, a gate driver 163, a source driver 164, a liquid crystal display panel 165 and an adjusting tool 166. A plurality of banks 161*a* are programmed in the reference voltage apparatus 161 to store corresponding individual Gamma values. The adjusting tool 166 includes a terminating machine 168, an adjusting module 167, a signal generator 169 and a sensor 170. In one embodiment, the terminating machine 168 is a personal computer, and the adjusting module 167 includes a microprocessor 167*a*. The signal generator 169 is a programmable video signal generator for providing a signal to the liquid crystal display panel 165. The sensor 170 is an optical sensor for detecting brightness of the liquid crystal display panel 165.

In un-known cell gap size ($h_x$), method of selecting a gamma voltage by utilizing a sensor measuring includes the following steps, firstly, standard liquid crystal display panels 165 with uniform and various cell gap size ($h_i$) are selected, wherein each one of the liquid crystal display panels 165 uses a gamma voltage $VGM1_{h_0}$, cell gap $h_0$ ($\gamma=2.2$), and programming banks in the reference voltage apparatus 161. The measured brightness $Y_{186,h_i}$ (shown in A point of the FIG. 6) is substituted into the equation (6) to find gray scale $X_{h_i}$ at one half $Y_{max}$ brightness (shown in C point of the FIG. 6) of each one standard liquid crystal display panels, wherein the corresponding relation between $Y_{186,h_i}$, and $X_{h_i}$ refers to the second table. The gray scale $X_{h_i}$ and one half $Y_{max}$ brightness are then stored.

Figure 11:
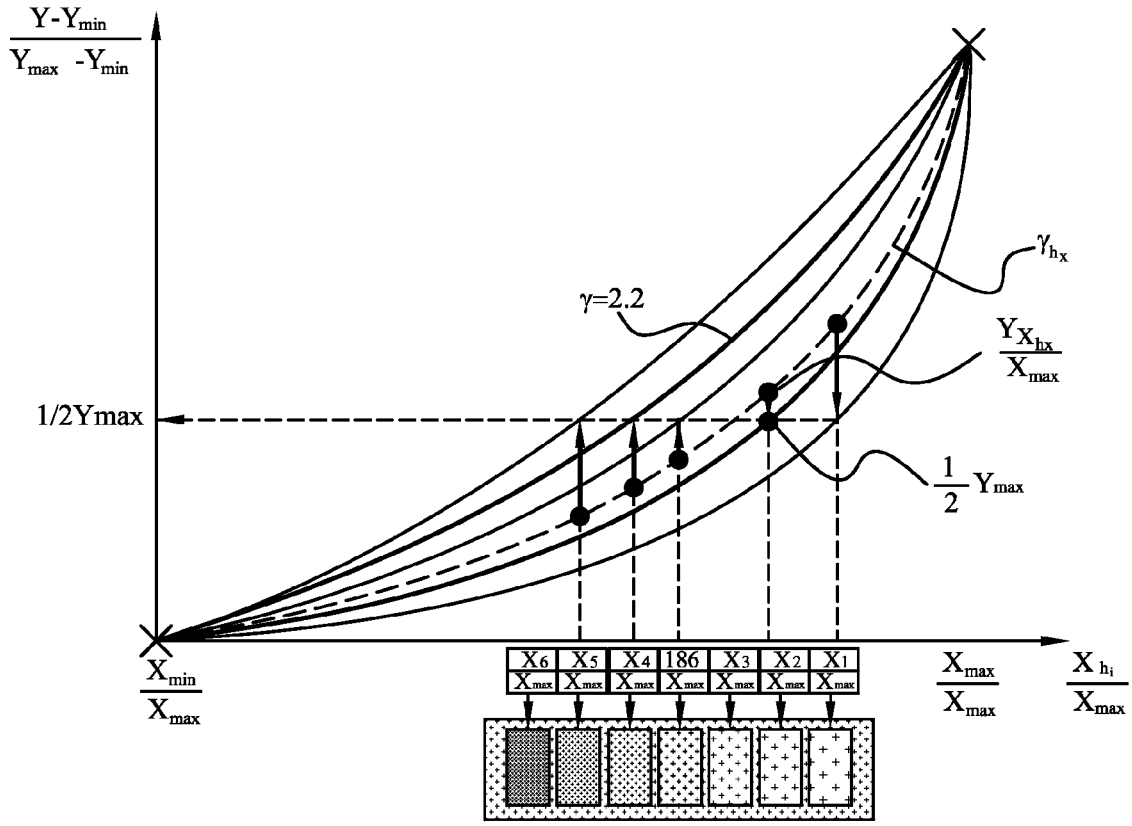
FIG. 11 shows a graph of brightness, gray scale by sensor measuring and selecting a gamma voltage according to the present invention.

When the cell gap size is a certain un-known value $h_x$, switching the picture to gray scale $X_{h_i}$, for example $X_{h_0}$, $X_{h_1}$, $X_{h_2}$, $X_{h_4}$, $X_{h_5}$, $X_{h_5}$, $X_{h_6}$. Once switching one gray scale, measuring brightness $Y_{X h_i}$ of the gray scale by a sensor and then selecting $Y_{X h_i}$ close to one half ½ $Y_{max}$, corresponding the cell gap size $h_i$ of such gray scale $X_{h_i}$ is about un-known cell gap size $h_x$, i.e. $h_i$%, selecting a gamma voltage of the cell gap size $h_i$ corresponding to $Bank_{h_i}$ (for example the first table), shown in FIG. 11. The gamma voltage is stored in $Bank_{h_x}$ as output. Meanwhile, bank signal is set by the timing controller 162, and only waveform of $Bank_{h_x}$ inputs into the reference voltage apparatus 161 which each frame rate cycle uses the identical gamma voltage, shown in FIG. 12.

As shown in FIG. 7, if cell gap of a liquid crystal display panel 136 is $h_x$, then a terminal personal computer controls a programmable video signal generator 133 for sending the cell gap pattern gray scale ($X_{h_i}$) 132 to the liquid crystal display panel 136. When the cell gap size is a certain un-known value $h_x$, switching the picture to gray scale $X_{h_i}$. Each switching gray scale $X_{h_i}$ with manufacture complete gray scale ($X_{hx}$) 135, shown in block 134. Brightness $Y_{hx}$ of the liquid crystal display panel is measured by a sensor. If the brightness $Y_{hx}$ is close to one half $Y_{max}$ brightness, then corresponding the cell gap size $h_i$ of such gray scale $X_{h_i}$ is approximately un-known cell gap size $h_x$, i.e. $h_x \approx h_i$. Such method is automatically selecting gamma voltage by utilizing a sensor identifying.

From above description, in the present invention provides a method for correcting a gamma voltage of making a liquid crystal display panel. The method comprises the following steps, firstly, storing a plurality of gamma voltage in a plurality of banks of a reference voltage apparatus, then based-on lateral divided sections of each liquid crystal display panel, measuring a gamma voltage of divided equi-partition sections of each LCD panel by a plurality of sensors, and storing measuring value in the banks, finally, based-on a cell gap size of the lateral divided sections of each liquid crystal display panel, selecting suitable gamma voltage by the sensors measuring to compensate the difference due to the cell gap.

The method of selecting suitable gamma voltage by the sensors measuring comprises the following steps: selecting standard liquid crystal display panels with uniform and various cell gap size ($h_i$), each one of the liquid crystal display panels using a gamma voltage $VGM_{h_0}$, cell gap size$_{h_0}$ ($\gamma$=2.2); substituting the measured brightness $Y_{186,h_i}$ into the equation to find gray scale $X_{h_i}$, at one half $Y_{max}$ brightness of the standard liquid crystal display panel, storing data of the gray scale $X_{h_i}$ and one half $Y_{max}$ brightness. When the cell gap size $h_x$ is a certain un-known value, switching a picture to a plurality of gray scale for measuring brightness of each one gray scale by the sensor. If the brightness is one half $Y_{max}$ brightness, then based-on the cell gap size $h_i$ of the gray scale $X_{h_i}$ selecting a gamma voltage corresponding to $Bank_{h_i}$, storing the gamma voltage in $Bank_{h_x}$ as output. Bank signal is set by a timing controller, and only waveform of $Bank_{h_x}$ inputs into a reference voltage apparatus which each frame rate cycle uses the identical gamma voltage.

Moreover, the method of selecting a suitable gamma voltage by visual method of cell gap pattern comprises the following steps: selecting standard liquid crystal display panels with uniform and various cell gap size ($h_i$), each one of the liquid crystal display panels using a gamma voltage $VGM_{h_0}$, cell gap size $h_0$($\gamma$=2.2); substituting the measured brightness $Y_{186,h_i}$ into the equation to find gray scale $X_{h_i}$ at one half $Y_{max}$ brightness of the standard liquid crystal display panel for making pattern. The more the brightness $Y_{186,h_i}$ is, the less the gray scale is. When the cell gap size $h_x$ is a certain un-known value, switching a picture to a plurality of gray scale is made for selecting the closest gray scale by the visual method of cell gap pattern. Based-on the cell gap size $h_i$ of the gray scale $X_{h_i}$ selecting a gamma voltage corresponding to $Bank_{h_i}$ is made, storing the gamma voltage in $Bank_{h_x}$ as output. Bank signal is set by a timing controller, and only waveform of $Bank_{h_x}$ inputs into a reference voltage apparatus which each frame rate cycle uses the identical gamma voltage.

The above description of the invention is illustrative, and is not intended to be limiting. It will thus be appreciated that various additions, substitutions and modifications may be made to the above described embodiments without departing from the scope of the present invention. Accordingly, the scope of the present invention should be construed in reference to the appended claims.

What is claimed is:

1. A method for selecting a gamma voltage of a liquid crystal display panel, comprising:

storing a plurality of first gamma voltage in a plurality of banks of a reference voltage apparatus;

measuring a second gamma voltage of divided sections of a liquid crystal display panel, storing said second gamma voltage in one of said plurality of banks; and selecting corresponding one of said plurality of first gamma voltage after performing a sensor measuring or by a pattern selecting;

wherein said selection of corresponding one of said plurality of first gamma voltage is used to compensate difference due to a cell gap of said divided sections.

2. The method of claim 1, wherein said divided sections are lateral equi-partition sections.

3. The method of claim 1, wherein said sensor measuring comprises:

storing a first brightness, based-on corresponding a plurality of first gray scale of a standard liquid crystal display panel;

switching a picture to one of said plurality of first gray scale for measuring a second brightness of second gray scale of said divided sections by said sensor, storing one of said plurality of first gamma voltage corresponding to said second gray scale in one of said plurality of banks as output; and inputting one signal of said plurality of banks into said reference voltage apparatus.

4. The method of claim 3, wherein said second brightness is one half of maximum brightness, corresponding cell gap of said second gray scale corresponds to one of said plurality of first gamma voltage.

5. The method of claim 1, wherein said pattern selecting comprises:

storing a first brightness, based-on corresponding a plurality of first gray scale of a standard liquid crystal display panel;

switching a picture to one of said plurality of first gray scale, selecting a second gray scale of one of said divided sections of the closest to said first gray scale by the visual method, storing one of said plurality of first gamma voltage corresponding to said second gray scale in one of said plurality of banks as output; and inputting one signal of said plurality of banks into said reference voltage apparatus.

6. A system for selecting a gamma voltage of a liquid crystal display panel, comprising:

a DC/DC converter;

a reference voltage coupled to said DC/DC converter, having a plurality of banks, each one of said plurality of banks for storing a gamma voltage;

a timing controller, coupled to said reference voltage apparatus for setting and controlling signals of said plurality of banks;

a source driver, coupled to said timing controller and said reference voltage apparatus for corresponding gamma voltage of each one of plurality of banks outputting to said source driver;

a gate driver, coupled to said timing controller for turning on or off a transistor;

a liquid crystal display panel, coupled to said gate driver and said source driver; and an adjusting tool coupled to said reference voltage apparatus and said liquid crystal display panel, wherein said adjusting tool comprises:

a terminating machine;

an adjusting module, coupled to said terminating machine and said reference voltage apparatus for transmitting first signal to one of said plurality banks to output corresponding said gamma voltage, wherein said adjusting module includes a microprocessor;

a signal generator, coupled to said terminating machine and said liquid crystal display panel for providing second signal to said liquid crystal display panel; and a sensor, coupled to said liquid crystal display panel and said adjusting module for detecting a brightness of said liquid crystal display panel.

7. The system of claim 6, wherein said signal generator is a programmable video signal generator.

* * * * *